US007732692B2

(12) United States Patent
Mori et al.

(10) Patent No.: US 7,732,692 B2
(45) Date of Patent: Jun. 8, 2010

(54) ELECTRONIC PERCUSSION INSTRUMENT STAND

(75) Inventors: Yoshiaki Mori, Hamamatsu (JP); Koichi Nakao, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 12/016,164

(22) Filed: Jan. 17, 2008

(65) Prior Publication Data

US 2008/0229902 A1 Sep. 25, 2008

(30) Foreign Application Priority Data

Mar. 20, 2007 (JP) ..... 2007-072806

(51) Int. Cl.
*G10D 13/02* (2006.01)

(52) U.S. Cl. ..... 84/421; 248/170

(58) Field of Classification Search ..... 84/421, 84/422.1, 422.2, 422.3; D17/22; 248/170; 224/910; 211/189
See application file for complete search history.

(56) References Cited

U.S. PATENT DOCUMENTS 3,433,115 A * 3/1969 Kjelstrom ..... 84/411 R
5,140,889 A * 8/1992 Segan et al. ..... 84/723
5,370,248 A * 12/1994 Robolin ..... 211/189
6,075,197 A * 6/2000 Chan ..... 84/730
6,278,046 B1 * 8/2001 Sikra et al. ..... 84/422.1
7,348,479 B1 * 3/2008 Lombardi ..... 84/422.1

FOREIGN PATENT DOCUMENTS

JP 2006-259193 9/2006

* cited by examiner

*Primary Examiner*—Jianchun Qin
(74) *Attorney, Agent, or Firm*—Foley & Lardner LLP

(57) ABSTRACT

An electronic percussion instrument stand includes a center pipe structure. The center pipe structure has at least one center pipe having a longitudinal axis. A center pipe structure with at least two center pipes provides increased stability. A crescent-shaped base structure supports the center pipe structure in an upright orientation. At least one first arm supports at least one electronic percussion instrument. At least one first joint connects first arm to the center pipe structure. Each joint is adjustable in a direction of the longitudinal axis of the center pipe and in a direction around the longitudinal axis of the center pipe, for adjusting the position of the first arm. Each joint is adjustable between a position for playing electronic percussion instruments supported on the at least one arm, to a retracted position for transportation.

32 Claims, 5 Drawing Sheets

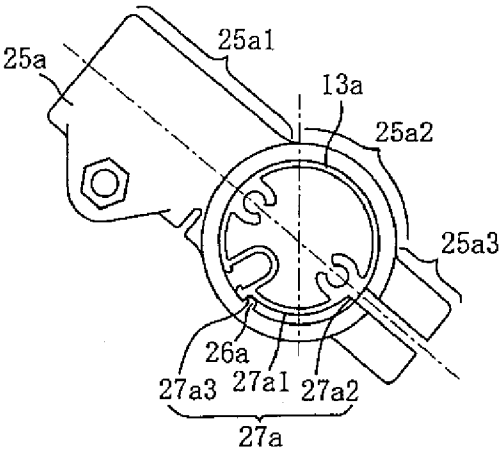
Figure 3 ( c −1)
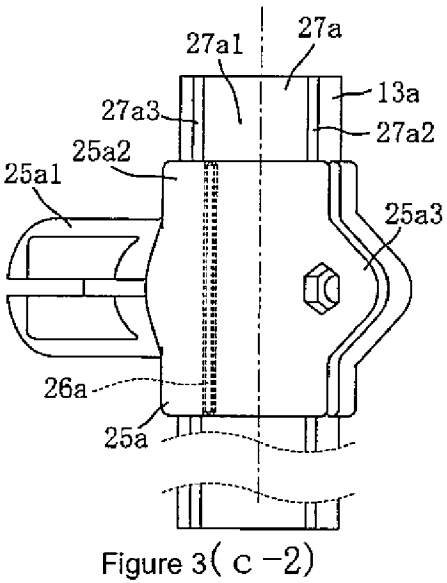
Figure 3 ( c −2)
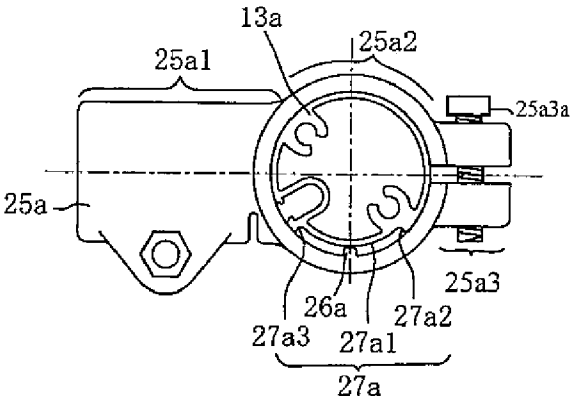
Figure 3 ( b −1)
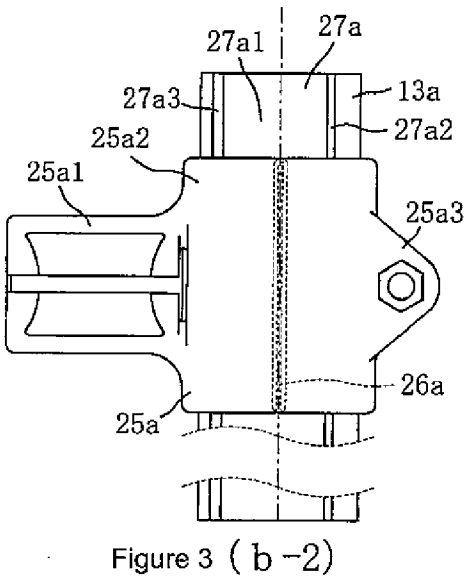
Figure 3 ( b −2)
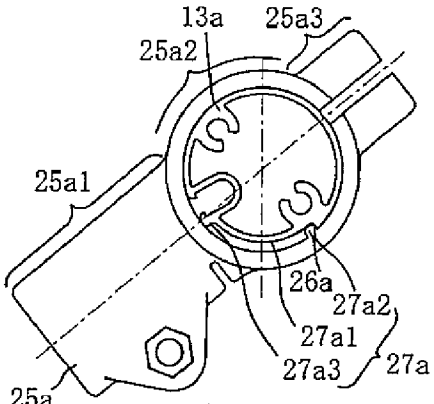
Figure 3 ( a −1)
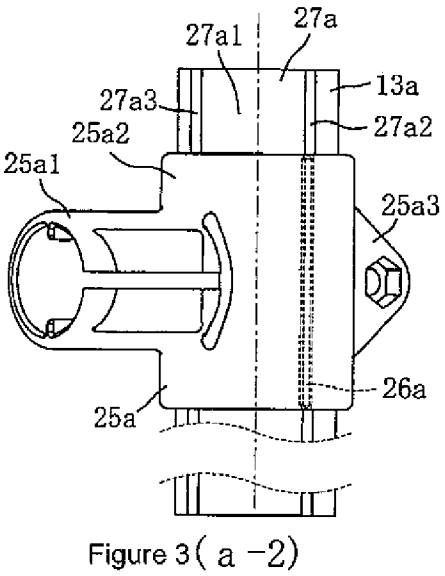
Figure 3 ( a −2)

ELECTRONIC PERCUSSION INSTRUMENT STAND

CROSS-REFERENCE TO RELATED PATENT APPLICATIONS

Priority Application 2007-072806, filed Mar. 20, 2007 including the specification, drawings, claims and abstract, is incorporated herein by reference in its entirety.

BACKGROUND OF THE DISCLOSURE

1. Field of the Invention

Embodiments of the present invention relate to an electronic percussion instrument stand and particular embodiments relate to a professional level electronic percussion stand which is easy to adjust with a great amount of adaptability and possible settings.

2. Background

An instrument stand described in Japanese Patent Publication No. 2006-259193 is intended for musicians for use with electronic percussion instruments, including but not limited to electronic cymbals, electronic drums, electronic bass drums, foot pedals and any other components typically found in a musicians percussion drum set. Within an electronic drum set the electronic drums as well as the electronic cymbals are attached to a stand structure, and depending on the preference of the individual artist, the bass drum and foot pedals can also be arranged within the stand architecture.

A standard setup for an electronic drum set may have the electronic drum and the electronic cymbals arrayed along a stand assembly framework with L shaped supporting tubing. In many cases, the tubing used was nearly identical to water flow type pipes. While previous electronic drum and electronic cymbal setups have used water type pipes and L formations, embodiments of the present invention provide an alternative choice and a capability to select favorite settings.

It has been observed that when breaking down and transporting a typical, existing standard electronic drum set having both electronic drum components and electronic cymbal components on an L shaped water pipe, can be both cumbersome and heavy and a great burden to move, particularly when the drum set includes a base drum. In order to break down and transport a stand assembly of typical prior designs, it was necessary to separate the electronic drums and the electronic cymbals from the stand assembly and then reassemble the entire structure again later in order to play. With each re-assembly, the setting must be recalibrated for the electronic drum and electronic cymbal, which can cause a great deal of lost time and effort as well as frustration on the part of the musician.

Also, for storing such typical stand structures, the electronic drums and electronic cymbals must be removed from the stand and stored separately from the stand, which can require additional effort to transport the components and store the bulky piping of the stand assembly structure. The act of disassembly of the pipe stand assembly as well as the act of removing the electronic drums and electronic cymbals can require a significant effort. The necessity to disassemble, move, reassemble and reset can be a very time consuming process, particularly the re positioning of the electronic instruments to the artists satisfaction upon reassembly.

Embodiments of the present invention may be configured to minimize these problems and inconveniences. Embodiments of the present invention provide an electronic percussion instrument stand which is simple to disassemble, transport, reassemble and adjust to the artist's satisfaction.

SUMMARY OF THE DISCLOSURE

Accordingly, a first embodiment of the present invention relates to an electronic percussion instrument stand design which allows the artist an improved pipe structure for a stand assembly, including a double arm system with a single base and a counterbalanced axis system that provides the artist with flexibility and access to an optional additional playing platform.

A second embodiment of the electronic percussion instrument stand relates to features of the base portion of the stand and multiple connection ports on both sides of the base and the ability of the base to support the arm segments at any one of a plurality of multiple settings along various axis lines. Opposing center pipes are designed to give maximum flexibility while still providing the base with the ability to provide the entire structure maximum stability even under the most extreme adjustments of the arm segments.

A third embodiment relates to features of the second embodiment. In its first primary setting, a stand structure according to the first embodiment is able to be adjusted along multiple axes by shifting the pipe structures. The center pipes are capable of being connected to multiple connecting arms through first and second joint structures, while the base structure is also able to be connected to the center pipe structure and aligned while maintaining support for the overall stability of the stand apparatus.

Improved functionality can be provided by employing a half rounded (generally semi-circular or "C" shape form) form of the base and its ability to maintain stability and functionality in virtually any configuration. In addition, embodiments with the half rounded (generally semi-circular or "C" shaped) base can provide the above-mentioned support capabilities with a relatively light weight structure.

A fourth embodiment relates to the second or third embodiments wherein the base component is shaped in a half rounded (or generally semi circular form) to increase stability and decrease weight. In addition, the arm structure is connected to the center pipe structure that extends from a central point of the base. Electronic percussion instruments as well as accessories are attached to the arm structure and the center pipe structure.

A fifth embodiment relates to the first, second, third or fourth embodiments, wherein the pipe structure is divided into two separate pipe units. Each of these separate pipe units is independently capable of joining with the various instruments which may be attached to this stand structure. When attached to a first pipe unit, each arm is also capable of independent free motion to place it in a virtually unlimited number of positions.

A sixth embodiment of an electronic percussion instrument stand apparatus includes hollow portions of the stand apparatus and relates to how they connect with the interior sections of the axis shaft. The pipe structure is connected in a manner in which a hollow core of the connected tubing pipes extend contiguously throughout the pipe structure from the base unit, up through the arms and outside to a musical instrument attachment point. In the event of change adjustment of configuration, the connected hollow interior paths would still run from the center through the structure of the stand out to the musical instrument connection point, through a first sidewall structure. When the configuration of a stand structure according to an embodiment of the present invention is adjusted to a near perpendicular stance, then the hollow portion of the interior of the shaft structure would run instead extend through a second sidewall structure to the musical instrument connection point.

In the above mentioned first embodiment of an electronic percussion instrument stand, when the pipe structure is in a vertical configuration, the musician can very efficiently strike at percussion instruments attached to the instrument attachment points along the arms. In this vertical setting, the base plate structure is directly connected to the arm components. In this way the base structure can very effectively handle the pressure applied not just from the instruments themselves but also from the repeated vigorous striking of the instruments by the artist, as well as provide support and stability to the second arm structure which allows the artist to connect still further instruments to a second instrument connecting point. Thus, a second separate stand structure is not required and, instead, an artist may assemble and position further instruments on the second arm structure at the second instrument connection point, all within a single stand structure. This combination of features and flexibility available with an electronic percussion instrument stand according to embodiments of the present invention can significantly reduce the amount of time required for setup and adjustment of the attached instruments. The second arm structure may be attached to the central pipe structure as well as the base as part of a single unit. Thus, the second instrument connecting point, being part of the single unit, will not require separate handling or assembly. As a result, the structure can be relatively easy to carry, assemble, and adjust.

With the electronic percussion stand unit adjusted in its vertical setting the artist will generally utilize a first instrument connection point for a primary percussion instrument. The design involved in the arm shaft piping can provide significant improvements over water type pipes, including providing the artist substantial flexibility in adjusting instrument positions.

In addition to features described above concerning the first and second embodiments of an instrument stand, the base structure may be connected to legs as well as the two arm structures. The arm structures and leg structures are connected to the base structure on either side of the axis of the base structure. Also because the arm structure, when placed in a vertical setting, is connected to the base via its vertical shaft pipe, the arm may be easily adaptable to multiple positions. Because the leg structures are connected to the base, on both sides of the base, the leg structures extend outward and, if left in that configuration, can become inconvenient when the electronic percussion instrument stand is to be transported. However, the leg structure is designed to fold back into the primary stand structure (when the piping structure collapses vertically into the primary stand structure) to reposition the leg structures out of the way.

The electronic percussion instrument stand structure according to the second and third embodiments relates to the structure described in connection with the first embodiment. In addition, the shaft ends are received into the interior of the shaft axis. Also, when positioned vertically the second joint and the base are aligned to set the stand structure in a linear, easily transportable position. When set in this position with the arm shafts vertical and the first and second base joints aligned as well as the legs retracted, the stand becomes easily transportable as well as easily adjusted from this configuration upon re set up. When the first and second arms are, along with the first and second joints, positioned as described above, the structure of this stand can be easy to move and reposition.

A fourth embodiment of an electronic percussion instrument stand includes features described above for the second or third embodiments. In addition, in the fourth embodiment, the base segment of the stand is half rounded or in the shape of a semi-circle or flattened crescent (or "C" shape). Also, the arm pipe and the coupling joints are attached via edge connectors to a central portion of the base plate structure. In addition the base plate structure has, on both sides of it, a coupling for the leg structures which support the stand apparatus and are capable of folding back against the base plate structure. The leg structures also support the second arm structure, including the second musical instrument connecting point, from their central location. In this way, the artist has the ability to shift the second musical instrument connecting point to multiple positions from which to more easily play. Without the ability to shift the second musical instrument connecting point, the artist may find it more difficult to position the instruments to a desired play position. However, with embodiments of the present invention, the artist has virtually total control over the positioning of the instruments and thus is more easily able to move the instruments to the artist's satisfaction for more efficiently play.

According to a fifth embodiment, the pipe units are constructed from 2 conjoined pipe sections, where one of these pipe sections is joined by an end connector. Also because each arm structure is composed of 2 conjoined pipe units, the artist is able to attach a musical instrument to the first musical instrument connector and adjust it to the artist's specifications, even vertically. The first musical instrument connector and the flexibility to use one or both of the arm structures gives the artist further freedom to, when playing music, adjust the attitude and pitch of the instrument on the stand.

Also when installing an instrument on the first musical instrument connection point, it is possible to use the structure with minimal risk of structural collapse or a need for counterbalance, because the pipe structure of the arm is such that both ends are equally strong and able to support weight. Also, the strength of the components may be selected such that the artist can easily move the instruments around even once they are installed on the stand. This includes adjusting of height, pitch, and attitude. This also includes the ability to easily, verticality adjust the position of the various components.

According to the sixth embodiment, in the event that the first musical instrument connection point is positioned in a vertical position, the arm connection joints utilize the internal hollow pipe interior to allow flow between the base areas and the first musical instrument connection point, through the hollow interior of the tubing. In the event of a large horizontal shifting of components and the arm structure, the hollow connection from the base to the first instrument connection point will be maintained through a second side wall connection. Thus the option exists of either utilizing a first side wall mount or a second side wall mount to maintain a flow through, thus during the transport and set up phase it is possible to choose between a wide number of options for place of necessary components within the flexible structure of this stand, especially to the first musical instrument connection point. Accordingly, transporting and setting up of the stand can be very simplified.

Various non-limiting embodiments of the invention are described below, utilizing illustrations of FIGS. 1-5. With reference to the illustration of FIG. 1 an explanation is provided regarding a way in which an electronic percussion stand unit 10 can be utilized with an electronic percussion system 1.

FIG. 1 shows a perspective view of an embodiment of the invention, from an external perspective.

BRIEF DESCRIPTION OF THE DRAWINGS

FIGS. 3(*a*-1) to 3(*c*-2) illustrate installation components and a center pipe according to an embodiment of the present invention;

DETAILED DESCRIPTION OF PREFERRED EMBODIMENTS

Figure 1:
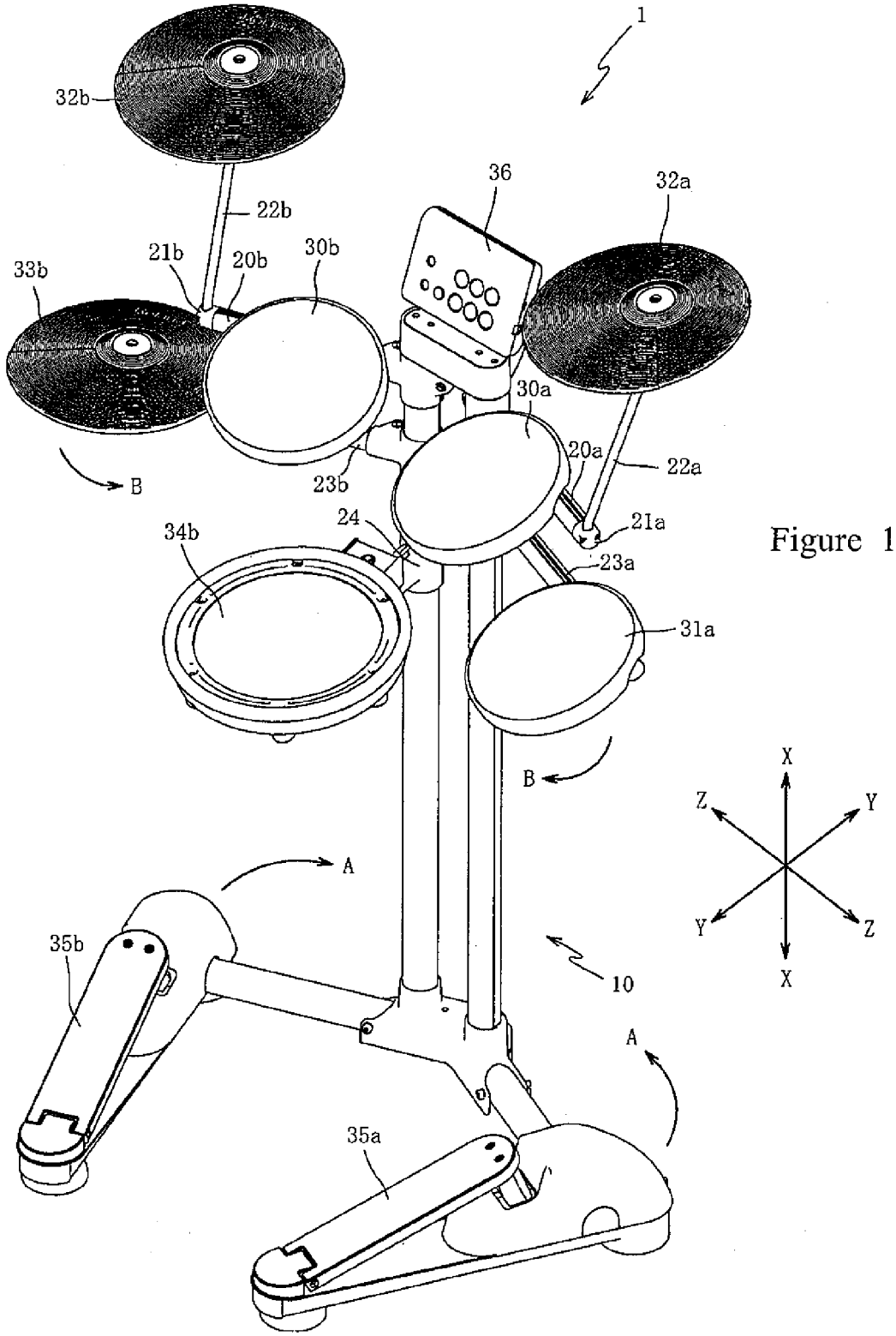
FIG. 1 is a perspective view of an electronic percussion instrument and stand system according to an embodiment of the present invention.

Various aspects of embodiments of the present invention are discussed below with reference to illustrations of FIGS. 1-5. With reference to FIG. 1, an explanation is provided regarding a way in which an electronic percussion instrument stand 10 can be used in an electronic percussion system 1. FIG. 1 shows a perspective view of an embodiment of the invention, from an external perspective.

In FIG. 1, the arrow X refers to a vertical direction, relative to the normal orientation of the electronic percussion instrument system 1 (and electronic percussion instrument stand 10), while the arrow Y shows a direction from the front to the back of the electronic percussion instrument system 1 (and electronic percussion instrument stand 10) and the arrow Z shows the left-right direction of the electronic percussion instrument system 1 (and electronic percussion instrument stand 10). Also arrows A and B show adjustment directions for the electronic percussion instrument system 1.

As shown in FIG. 1 the electronic percussion instrument system 1 may include one or more of the following components attached to the electronic percussion instrument stand 10 which may be utilized by an artist to strike and make music: drum pads 30*a*, 30*b*, 31*a*, cymbal pads 32*a*, 32*b*, high hat cymbal 33*b*, snare pad 34*b*, foot pedals 35*a*, 35*b*, and a the sound source processor or controller 36. In further embodiments, other suitable components may be included in the electronic percussion instrument system 1.

Because such components as the drum pads 30*a*, 30*b*, 31*a*, cymbal pads 32*a*, 32*b*, high hat cymbal 33*b*, snare pad 34*b*, and the foot petals 35*a*, 35*b* may be common and well known elements of a typical percussion instrument set, further explanation of each those component is not provided herein. The controller or sound source 36 may be a component which receives electronic input signals (input signals based on the frequency and strength of each strike upon the pad and step on the foot petal) from the components drum pads 30*a*, 30*b*, 31*a*, cymbal pads 32*a*, 32*b*, high hat cymbal 33*b*, snare pad 34*b*, and the foot petals 35*a*, 35*b* and provides electronic signals for generating audio sounds through other components such as speakers and other electronic output components (not shown).

The drum pad 30*a* is connected to a center pipe 13*a* (see FIG. 2) by the arm pipe 20*a*. Cymbal pad 32*a* is joined with the arm pipe 20*a* via the end of a coupling member 21*a* and held vertically above the arm pipe 20*a* (in the direction X in FIG. 2) and supported by a stabilizing rod 22*a*. Also the drum pad 31*a* is supported by the center pipe 13*a*, through the arm pipe 23*a*.

Figure 2:
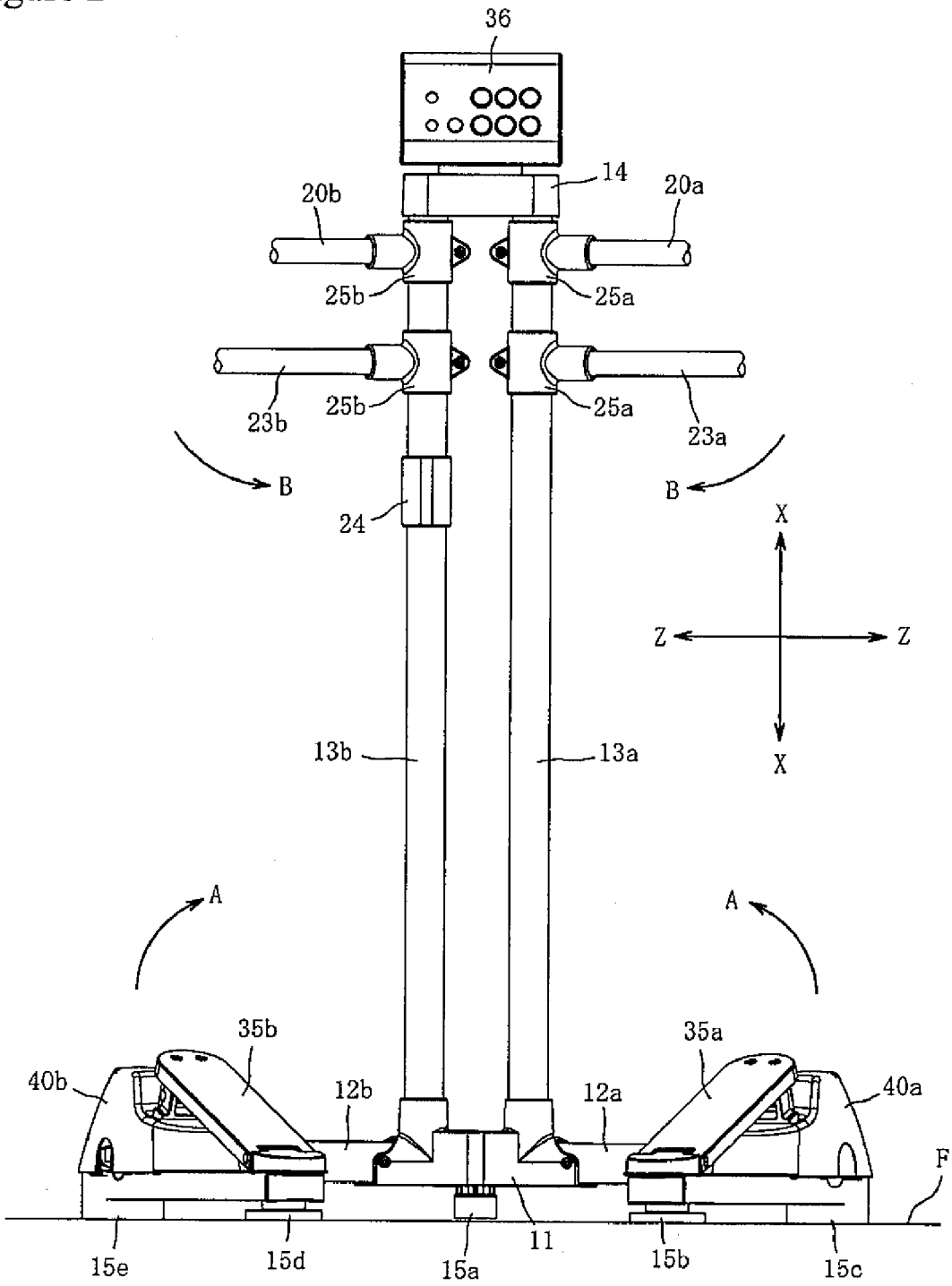
FIG. 2 is a rear view of a portion of the electronic percussion instrument stand of the system of FIG. 1.

The drum pad 30*b* is connected to a center pipe 13*b* by the arm pipe 20*b* (see FIG. 2). Cymbal part 32*b* is joined with the arm pipe 20*b* via an end of the coupling member 21*b* and held vertically above the arm pipe 20*b* (in the direction X in FIG. 2) and supported by the stabilizing rod 22*a*. Also the high hat cymbal 33*b* is connected to the center pipe 13*b* by the arm pipe 23*b*. The snare pad 34*b* is attached to the center pipe 13*b* via the joint component 24.

The foot petals 35*a* and 35*b* are attached to the lower portions of the electronic percussion instrument stand 10 (see the lower portion of FIGS. 1 and 2) and are positioned on the player's side of the electronic percussion instrument stand 10.

FIG. 2 is a diagram showing various directions of positioning of the electronic percussion instrument stand 10. In FIG. 2, the instruments and other components upon which an artist produces music are not shown.

In FIG. 2, the electronic percussion instrument stand 10 has a base structure 11 that is set on a flat surface F. Extending at least partially in the directions of arrows Z from the base structure 11 is attached a leg pipe 12*a* and a leg pipe 12*b*. A leg component 40*a* (supporting the foot pedal 35*a*) is attached to the leg pipe 12*a* and a leg component 40*b* (supporting the foot pedal 35*b*) is attached to the leg pipe 12*b*. Also attached and extending vertically (in the direction of arrow X) from the base structure 11 is a center pipe structure composed of center pipes 13*a* and 13*b*. The controller component 36 is attached to the center pipe structure through a holder 14.

Attached to the center pipe 13*a* are two joint components 25*a* for attaching the arm pipes 20*a* and 23*a*, respectively, to the center pipe 13*a*. Also a joint component 24 is attached to the center pipe 13*b*, and two further joint components 25*b* attached arm pipes 20*b* and 23*b*, respectively, to the center pipe 13*b*. The joint components 25*a*, 25*b* and 24 may have a similar structure.

The joint components 25*a*, 25*b*, and 24 may be configured to always be connected to the center pipes 13*a* and 13*b* and the grip with which these components hold onto the center pipes is adjusted via a screw (such as a manually operable set screw or the like, not shown in the drawing). Also the vertical positioning of the joint components 25*a*, 25*b*, and 24 (see FIG. 2, arrow X) along the center pipes 13*a* and 13*b* can be altered easily and quickly.

The center pipes 13*a* and 13*b* are parallel to each other and can be arranged horizontally, closer or further apart from each other. By minimizing the distance between the two center pipes 13*a* and 13*b*, the electronic percussion stand 10 can take on a more compact configuration for easier transportation (see FIG. 2 arrow Z). In order to allow for ease of collapse of the electronic percussion stand assembly, each of the joint components 25*a*, 25*b*, and 24, once released, may rotate around the axis of one of the center pipes 13*a* and 13*b* and thus allow the electronic percussion instrument stand to collapse in on itself making it more compact and portable.

Attached to the underside of the base 11 is a pedestal 15*a* for resting on the surface F. Attached to the underside of the leg component 40*a* are pedestals 15*b* and 15*c* for resting on the surface F. Similarly, attached to the underside of the leg component 40*b* are pedestals 15*d* and 15*e* for resting on the surface F. The entire electronic percussion instrument stand assembly is supported by the pedestals 15*a*-*e* on the surface F. At the same time the base 11 as well as the leg components 40*a* and 40*b* are stabilized and bold the center pipes 13*a* and 13*b* vertical (in the direction X).

Also as shown in FIG. 2, the leg components 40*a* and 40*b* are connected to pipes 12*a* and 12*b*, while the pipes 12*a* and 12*b* are connected to the base unit 11 (at the center of the base unit) where the components all meet. Also as shown in FIG. 1, the base 11 is held with its crescent shape arranged horizontal along the surface F. The pedestals 15*a-e* are arranged around the base unit 11 and legs 40*a* and 40*b*, in a configuration, such as, but not limited to a general pentagon shape, for providing a high degree of stability for the entire electronic percussion instrument stand assembly 10.

The leg components 40*a* and 40*b* are connected to the ends of the pipes 12*a* and 12*b* and extend away from the base unit 11, which allows the leg components that support the artist's foot pedals 35*a* and 35*b* to be positioned away from (to the sides of, in the Z direction) the primary assembly and allows the artist much easier access to the pedal. Thus the artist is able to depress the foot pedals 35*a* and 35*b* with ease and minimal wasted motion.

While the leg components 40*a* and 40*b* may be attached to the pipe units 12*a* and 12*b*, the leg components 40*a* and 40*b* are movable so that the position and attitude of the leg components 40*a* and 40*b* may be shifted as per the artist's desire. This is aided by the length of pipes 12*a* and 12*b* as well as by the size of leg components 40*a* and 40*b*. In one embodiment, the pipe units 12*a* and 12*b* have a nearly 30 degree range of motion in the direction of arrow A with which to be adjusted for ease of use. Other embodiments may be configured to provide other suitable ranges of motion.

With reference to FIGS. 3(*a*-1) to 3(*c*-2), examples of joint components 25*a*, 25*b* and 24 are described. FIGS. 3(*a*-1) to 3(*c*-2) are diagrams of the connection between the joint component 25*a* and the center pipe 13*a*. Because the joint components 25*a*, 25*b* and 24 are identical, only the joint component 25*a* is fully explained, where the explanation applies equally well to joint components 25*b* and 24.

In the illustrations in FIGS. 3(*a*-1) and 3(*a*-2), the joint component is shown as if the drum pads 30*a* and 31*a*, cymbal pad 32*a* are placed in a first position. In the illustrations of FIGS. 3(*c*-1) and 3(*c*-2), the joint component is shown as if the drum pads 30*a* and 31*a* and cymbal pad 32*a* are placed in a second, different position. In the illustrations of FIGS. 3(*b*-1) and 3(*b*-2), the joint component is shown as if the drum pads 30*a* and 31*a* and cymbal pad 32*a* are placed in a middle position, between the positions shown in FIGS. 3(*a*-1), 3(*a*-2), 3(*c*-1) and 3(*c*-2).

FIG. 3(*a*-1) shows the joint component 25*a* and its relationship to the center pipe 13*a*. The joint component 25*a* is also connected to the pipe 20*a* (or the pipe 23*a*), as shown at 25*a*1. The attachment of the joint component 25*a* to the center pipe 13*a* is shown at 25*a*2 and a further attachment for securing the joint component to the center pipe 13*a* is shown at 25*a*3.

Once the joint component 25*a*1 is rotated around the axis of the center pipe 13*a* to adjust the arm pipes 20*a* and 23*a* in proper angle of alignment, the position can be locked down with a tightening of a screw 25*a*3*a* and the arm pipes 20*a* and 23*a* will be locked into place relative to the center pipe 13*a*.

The setting of the vertical hold height between attachment position 25*a*3 and pipes 20*a* and 23*a* can be accomplished as explained above, by tightening a screw (not shown) to lock in place the pipes 20*a* and 23*a*, once the optimal height has been selected. The joint components 25*a* keep the arm pipes 20*a* and 23*a* secure along the center pipe 13*a*.

The interior of the connector piece 25*a*3 (illustrated in FIG. 3(*a*-1)) on center pipe 13*a*) has a protrusion 26*a* extending toward the axis of the center pipe 13*a* within the center of the connector portion 25*a*3. Also the exterior surface of the center pipe 13*a* (the surface facing the joint component 25*a*) has a groove 27*a*.

Figure 5:
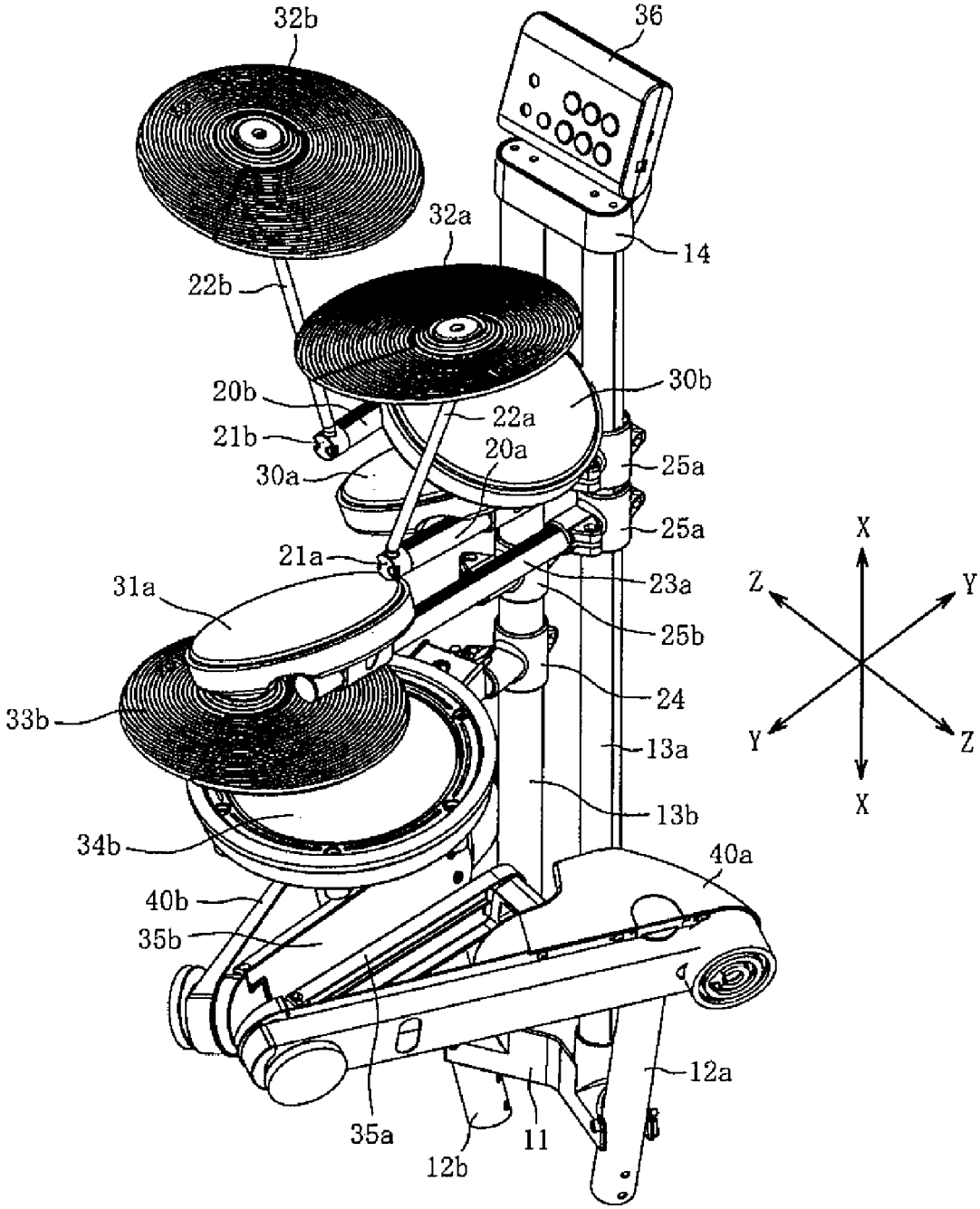
FIG. 5 is a perspective view illustrating an electronic percussion instrument system in a collapsed or folded orientation, for example, ready for transport.

The joint component 25 is regulated in its movements around the axial direction of the center pipe by the groove 27*a* and protrusion 26*a*. The groove 27*a* is provided along the lengthwise dimension of the center pipe and is bordered by groove end walls 27*a*2 and 27*a*3 and surface 27*a*1. The axial movement of the joint component 25 relative to the center pipe 13*a* allows the protrusion 26*a* on the joint component 25*a* to move between the groove end walls 27*a*2 and 27*a*3. Protrusion 26*a* also regulates vertical movement along the center pipe 13*a* (where FIG. 5 shows the extent of the movement placed on the center pipe 13*a* by the protrusion 26*a*). Part 27*a*1 is the groove between end walls 27*a*2 and 27*a*3 in the center pipe 13*a*.

FIGS. 3(*a*-1) and 3(*a*-2) show the effect upon the possible positioning (position settings) of drum equipments using a stand according to embodiments of the invention, and the possible range of motion available to an artist in their performance using this stand based on the adjustability range of the joint component 25*a*.

FIGS. 3(*c*-1) and 3(*c*-2) show possible positions for easy transport and collapse of the electronic percussion instrument stand system 10 and the position (collapsed positions) which each component could be moved to, including the drum pads 30*a*, 31*a* and the cymbal pads 32*a*, in order to accommodate easy transportation. In the illustration, the joint component 25*a* has been moved along the groove 27 in the center pipe 13*a*, to the groove end wall 27*a*3.

Embodiments of the electronic percussion instrument stand may be designed so that it becomes very simple and easy to move the musical components drum pads 30*a* and 31*a* and cymbal pads 32*a* from their basic position to their playing position by simply moving the joint component 25*a* such that the protrusion 26*a* moves along the groove 27*a* between the end walls 27*a*2 and 27*a*3.

Also shown in FIG. 3(*b*-1) and 3(*b*-2) is the ease with which one can change the various position settings by simply moving joint component 25*a* such that the protrusion 26*a* moves along the groove 27*a*. In this way, because almost any position is possible, the artist can select whichever position suits the artist best for the drum pads 30*a* and 31*a* as well as the cymbal pads 32*a*.

Figure 4:
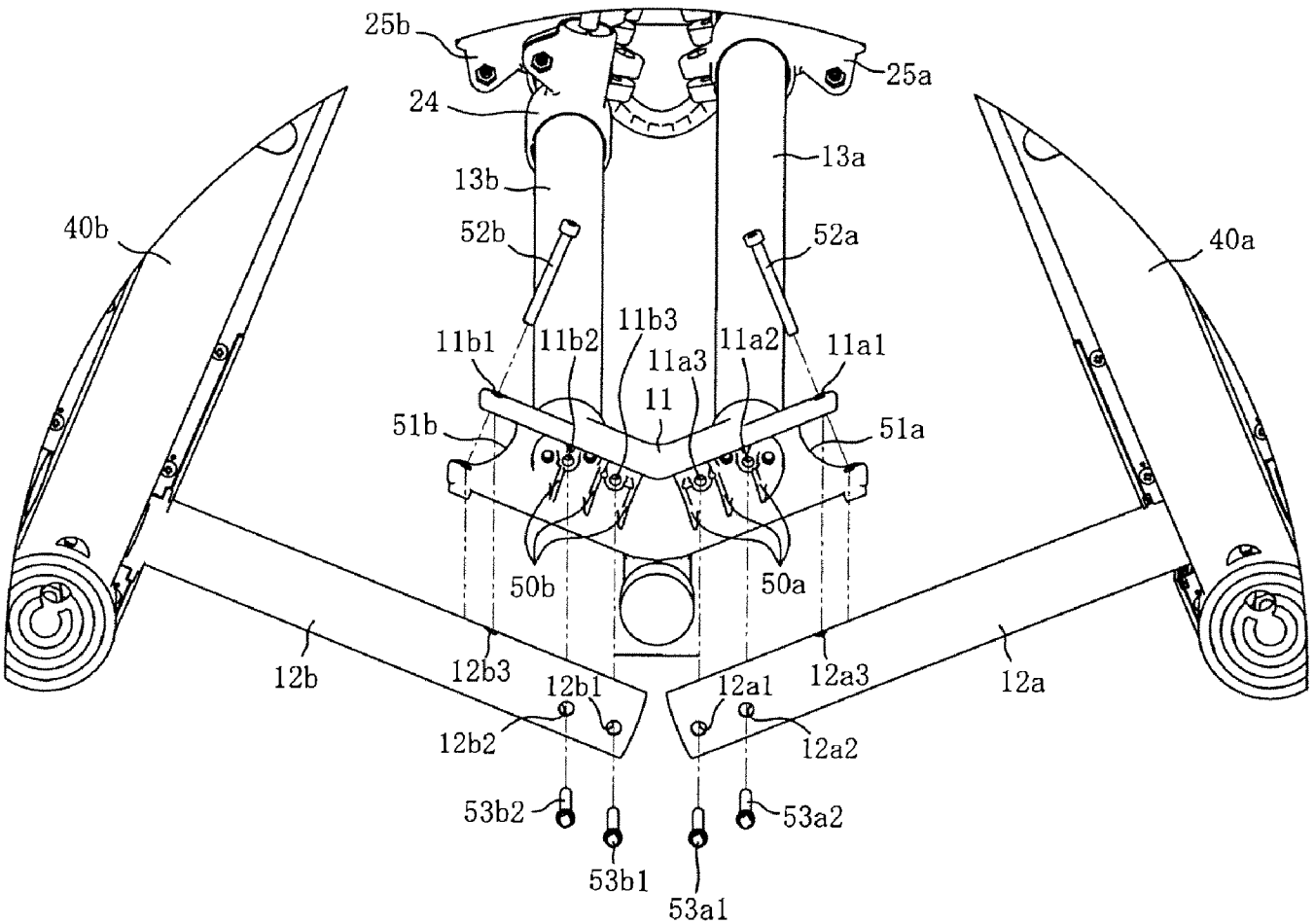
FIG. 4 illustrates an embodiment of a base structure and its connection with other components.

With reference to FIG. 4, the base section 11 and its connection with the two pipes 12*a* and 12*b* are described. FIG. 4 is a diagram drawing of the interrelation between the base 11 and the two pipes 12*a* and 12*b*.

FIG. 4 shows vertical channels through the pipes 12*a* and the first section 12*a*1 as well as vertical channels through the second section of the pipe 12*a*2 and the final level channel through the third section of pipe 12*a*3. As with pipe 12*a*, pipe 12*b* has the same structure and thus the vertical channels are shown through the pipe 12*b* and the first section 12*b*1 as well as the vertical channels through the second section of the pipe 12*b*2 and the final level channel through the third section of pipe 12*b*3.

The base 11 is formed in the shape of a partial circle or crescent shape (semi-circle or "C" shape), on the horizontal plane. The channel 11*a*1 extends through one side (the right side of FIG. 4) of the base 11 and the channel 11*b*1 extends through the other side (the left side of FIG. 4) of the base 11. Also from the interior of the base (on right side of FIG. 4) can been seen the two threaded portions 11*a*2 and 11*a*3 for receiving screws. From the other side (left side of FIG. 4) can be seen the interior of the base 11 and the two threaded portions 11*b*2 and 11*b*3 for receiving screws.

In the illustrated embodiment, the base component 11 has a generally half circle or crescent shape but it is also possible to give this piece a C shaped structure. Other shapes are possibilities for this piece.

By joining the base 11 with the pipe 12*a*, the alignment is such that the third channel 12*a*3 in the pipe 12*a* is aligned with the channel 11*a*1 in the base component, and a shaft 52*a* extends through the third channel to connect the base 11 and the pipe 12*a*. The screws 53*a*1 and 53*a*2 align with and connect with the first and second channels 12*a*1 and 12*a*2, respectively and screw into threaded portions 11*a*3 and 11*a*2 through the first and second channels 12*a*1 and 12*a*2, respectively.

Similarly, the base 11 is connected to the pipe 12*b*, where screws 53*b*1 and 53*b*2 screw into threaded portions 11*b*3 and 11*b*2, through the second channels 12*b*1 and 12*b*2 in the pipe 12*b*.

By removing the screws 53*a*1, 53*a*2, 53*b*1 and 53*b*2, it is possible to rotate the pipes 12*a* and 12*b* relative to the base unit, along the shafts 52*a* and 52*b*. However the pipes 12*a* and 12*b* remain attached to the base 11.

If screws are removed from the base 11, the base will reveal three protrusions 50*a* and a U shaped opening 51*a*. Protrusion 50*a* may be included to provide strength and adjustability to the electronic percussion instrument stand (in order that when the center pipes 13*a* and 13*b* are supporting full weight that they will maintain structurally cohesive). To adjust the pipe 12*a* when the pipe 12*a* is in an extended position or when the electronic percussion instrument stand 10 is placed in a transport position (in a vertically integrated position with all components retracted) the U shaped opening 51*a* allows pipe 12*a* to be pivoted to a greater extent relative to the base 11.

Also on the inside of the base 11 there are two screws 11*b*2 and 11*b*3 as well as three protrusions 50*b*. The base on its edge facing the pipe 12*b* can have a U shaped opening similar to the edge facing the pipe 12*a*.

On the exterior of pipes 12*a* and 12*b* the protrusions 50*a* and 50*b* are lined up with the grooves 51*a* and 51*b*. To aid in repositioning or packing the electronic percussion instrument stand 10 for transport, pipes 12*a* and 12*b* (and leg component 40*a* and 40*b*) have been designed to move easily and be easy locked in a collapsed or folded state.

FIG. 5 illustrates a position and procedures for readying the electronic percussion instrument stand unit 10 for transportation. FIG. 5 shows the electronic percussion instrument stand 10 in its transportation configuration.

In order to most efficiently configure the electronic percussion stand 10 for transportation, the bolts 25*a*3 and 25*b*3 may be loosened and the components may be slid along the various grooves (as shown in FIGS. 1 and 2 along the direction of the B arrows). Then the joint unit is rotated so that the position of protrusions 26*a* and 26*b* abut with the groove end walls 27*a*3 and 27*b*3 and the joint unit collapses along the opened pathway. Then the screws (not shown) may be re-tightened. When moving the joint components, the various musical components, drum pads 31*a*, 30*a* and 30*b*, cymbal pad 32*a*, high hat cymbal 33*b*, and the snare pad 34*b*, may be moved so that they do not hit against each other or the stand apparatus. An example of a proper positioning for all of these components is shown in FIG. 5.

Next, the electronic percussion instrument stand 10 may be laid down and the screws 53*a*1, 53*a*2, 53*b*1 and 53*b*2 may be tightened. The pipe 12*a* may be positioned against the center pipes 13*a* and 13*b* as shown in FIGS. 1 and 2 (along the direction of arrow A), to prepare the electronic percussion instrument stand 10 for travel.

As shown in FIG. 5, once the electronic percussion instrument stand has been set for travel, all of the components may be parallel to each other and it should be possible to carry it as one piece. Also, the stand has also become much more compact (the overall size having decreased and been compacted). Because it is possible to carry the electronic percussion stand in a single, compact piece, it is can be easy and convenient to carry the electronic percussion instrument system. Also because the foot pedals 35*a* and 35*b* are part of the electronic percussion stand unit 10 there is no need for a separate carrying case for the foot pedals 35*a* and 35*b* or to have to reset the positioning when the stand is set up again. And finally, because the electronic percussion instrument stand need not be broken down into multiple pieces for transport, the stand stays together as a single unit and can be relatively simple to reassemble and also to carry.

Because the installation components 25*a* and 25*b* have been moved along the grooved paths 27*a*3 and 27*b*3 against the protrusions 26*a* and 26*b*, the musical components, drum pads 30*a* 30*b* 31*a*, cymbal pad 32*a*, high hat cymbal pad 33*b*, snare pad 34*b* are all in position and can be very rapidly brought into alignment and playing position once the unit is set up again. Also pipes 12*a* and 12*b*, components 51*a* and 51*b* are repositioned as well as the base 11 and the foot components 40*a* and 40*b* are all retracted into a compact mass which makes the carrying and lifting of the unit relatively simple.

Reassembly can be a relatively simple operation, by simply reversing the process above. Reassembly can be effected by sliding installation components 25*a* and 25*b* back from the protrusions 26*a* and 26*b* then sliding them up the grooves 27*a*2 and 27*b*2. Then, it will not only be very simple to reposition the drum pads 30*a* 30*b* 31*a*, cymbal pad 32*a*, high hat cymbal pad 33*b*, and snare pad 34*b*, but by extending pipes 12*a* and 12*b* as well as the stand 11 and the protrusions 50*a* and 50*b* then the leg components 40*a* and 40*b*, the entire electronic percussion instrument stand unit 10 can be ready to play in mere moments.

We have endeavored in the above explanation of example embodiments of this invention, to show how such embodiments functions as well as the versatility of the design.

In the above presented design and illustrations, the stand embodiment includes twin center pipes 13*a* and 13*b*. However, in other embodiments, a single pipe could function in place of the two pipes 13*a* and 13*b*. In yet other embodiments, more than two center pipes may be used. With a design which incorporated only a single center pipe, it may not be practical to accommodate all of the above mentioned components; drum pads 30*a* 30*b* 31*a*, cymbal pad 32*a*, high hat cymbal pad 33*b*, snare pad 34*b*. However, by using some, but not all of those components, a single center pipe configuration may be suitable. If more than two center pipes are used, more musical components may be used and supported by the stand.

What is claimed is:

1. An electronic percussion instrument stand comprising:

a base structure having a generally rigid body configured to be supported on a surface;

a center pipe structure including a first pipe and a second pipe, each pipe having a respective longitudinal axis extending from the generally rigid body of the base structure in a generally vertical direction upon the generally rigid body of the base structure being supported on a surface;

wherein the longitudinal axis of the first pipe is spaced apart from the longitudinal axis of the second pipe;

a connection member coupled to both the first pipe and the second pipe, the connection member being vertically spaced apart from the base structure;

at least one first arm for supporting at least one electronic percussion instrument, the at least one first arm being connected to the first pipe or the second pipe at a location on the first pipe or the second pipe between the base structure and the connection member;

a first leg portion having a first foot pedal, the first leg portion connected to the generally rigid body of the base structure by a pivotal link, such that the first leg portion pivots relative to the generally rigid body of the base structure about a first pivot axis; and a second leg portion connected to the generally rigid body of the base structure by a pivotal link, such that the second leg portion pivots relative to the generally rigid body of the base structure about a second pivot axis, where the first and second pipes of the center pipe structure are located between the first and second pivot axes.

2. An electronic percussion instrument stand as recited in claim 1, wherein the foot pedal pivots with the first leg portion relative to the generally rigid body of the base structure.

3. An electronic percussion instrument stand as recited claim 1, further comprising at least one first joint for connecting the at least one first arm to at least one of the first and second pipes of the center pipe structure, each joint being adjustable in a direction of the longitudinal axis of at least one of the first and second pipes of the center pipe structure and in a direction around the longitudinal axis of at least one of the first and second pipes of the center pipe structure, for adjusting the position of the at least one first arm.

4. An electronic percussion instrument stand as recited in claim 3, wherein each joint is adjustable between a position for playing electronic percussion instruments supported on the at least one arm, to a retracted position for transportation.

5. An electronic percussion instrument stand as recited in claim 3, further comprising a second joint for connecting a further percussion instrument directly to the first or second pipe of the center pipe structure, the second joint being adjustable in a direction of the longitudinal axis of the first or second pipe of the center pipe structure and in a direction around the longitudinal axis of the first or second pipe of the center pipe structure, for adjusting the position of the further percussion instrument.

6. An electronic percussion instrument stand as recited in claim 1, further comprising:

a second leg pipe connected to and extending from the generally rigid body of the base structure;

a second leg portion having a second foot pedal.

7. An electronic percussion instrument stand as recited in claim 6, wherein the second leg portion is connected to the generally rigid body of the base structure by a pivotal link, allowing the second leg portion to pivot relative to the generally rigid body of the base structure about a second pivot axis.

8. An electronic percussion instrument stand as recited in claim 7, wherein the first leg portion is pivotal about an axis that is generally perpendicular to the longitudinal dimension of the first pipe of the center pipe structure.

9. An electronic percussion instrument stand as recited in claim 1, further comprising at least one second arm and at least one second joint, the at least one second joint connecting the at least one second arm to the second pipe, each second joint being adjustable in a direction of the longitudinal axis of the second pipe and in a direction around the longitudinal axis of the second pipe, for adjusting the position of the arm.

10. An electronic percussion instrument stand as recited in claim 1, wherein the base has a generally crescent shape.

11. An electronic percussion instrument stand as recited in claim 10, the first leg portion comprising a first leg pipe extending from a first end of the crescent shaped base and the stand further comprising a second leg portion comprising a second leg pipe extending from a second end of the crescent shaped base.

12. An electronic percussion instrument stand as recited in claim 11, the second leg portion having a second foot pedal connected to the second leg pipe.

13. An electronic percussion instrument stand as recited in claim 1, wherein the base structure is located at one end of the center pipe structure.

14. An electronic percussion instrument stand as recited in claim 1, wherein the connection member is configured to hold at least one electronic component.

15. An electronic percussion instrument stand as recited in claim 14, wherein the at least one electronic component includes a controller supported by the holder.

16. An electronic percussion instrument stand as recited in claim 1, further comprising, at least one first joint for connecting the at least one first arm to the first pipe, each first joint being adjustable in a direction of the longitudinal axis of the first pipe and in a direction around the longitudinal axis of the first pipe, for adjusting the position of the at least one first arm;

at least one second joint for connecting the at least one second arm to the second pipe, each second joint being adjustable in a direction of the longitudinal axis of the second pipe and in a direction around the longitudinal axis of the second pipe, for adjusting the position of the at least one second arm.

17. An electronic percussion instrument stand as recited in claim 16, wherein the at least one first arm is movable independently of the at least one second arm.

18. An electronic percussion instrument stand as recited in claim 1, wherein the base structure comprises a unitary body having a first and second receptacles for receiving the first and second pipes.

19. The electronic percussion instrument stand as recited in claim 1, wherein, the first leg portion is pivotally connected to the base structure at a connection location, the connection location being arranged between the base structure and the first foot pedal.

20. An electronic percussion instrument stand as recited in claim 1, wherein the generally rigid body of the base structure has a geometric center, and wherein the longitudinal axis of the first pipe and the longitudinal axis of the second pipe are spaced at substantially equal distances from the geometric center.

21. An electronic percussion instrument stand as recited in claim 20, wherein the geometric center of the generally rigid body of the base structure comprises a location on the generally rigid body of the base structure that is at one half of a horizontal length dimension of the generally rigid body of the base structure when the generally rigid body of the base structure is supported on the surface.

22. An electronic percussion instrument stand as recited in claim 1, wherein:

the first pipe of the center pipe structure is connected to the generally rigid body of the base structure at a location between the second pipe of the center pipe and the first pivot axis; and the second pipe of the center pipe is connected to the generally rigid body of the base structure at a location between the first pipe of the center pipe and the second pivotal axis.

23. An electronic percussion instrument stand as recited in claim 1, wherein the second leg portion has a second foot pedal that pivots with the second leg portion relative to the generally rigid body of the base structure.

24. An electronic percussion instrument and stand comprising:

a base structure having a generally rigid body configured to be supported on a surface;

a center pipe structure including at least a first center pipe and a second center pipe, each having a respective longitudinal axis extending from the generally rigid body of the base structure in a generally vertical direction upon the generally rigid body of the base structure being supported on a surface, the longitudinal axis of the first center pipe being spaced apart from the longitudinal axis of the second center pipe;

at least one first arm;

a plurality of electronic percussion instruments supported by the at least one first arm;

at least one first joint for connecting the at least one first arm to the center pipe structure, each joint being adjustable in a direction of the longitudinal axis of the center pipe and in a direction around the longitudinal axis of the center pipe, for adjusting the position of the at least one first arm;

a first leg portion, the first leg portion pivotally connected to the base structure at a first pivotal link such that the first leg portion pivots relative to the generally rigid body of the base structure about a first pivot axis, the first pivotal link being arranged on the base structure at a location between the center pipe structure and the first foot pedal; and a second leg portion connected to the generally rigid body of the base structure by a second pivotal link such that the second leg portion pivots relative to the generally rigid body of the base structure about a second pivot axis, where the first and second pipes of the center pipe structure are located between the first and second pivot axes.

25. An electronic percussion instrument and stand as recited in claim 24, wherein each joint is adjustable between a position for playing the electronic percussion instruments supported on the at least one arm, to a retracted position for transportation.

26. An electronic percussion instrument stand as recited in claim 24, further comprising at least one second arm and at least one second joint, the at least one second joint connecting the at least one second arm to the second center pipe, each second joint being adjustable in a direction of the longitudinal axis of the second center pipe and in a direction around the longitudinal axis of the second center pipe, for adjusting the position of the arm; and at least one further percussion instrument supported by the second arm.

27. An electronic percussion instrument stand as recited in claim 26, wherein the at least one first arm is movable independently of the at least one second arm.

28. An electronic percussion instrument stand as recited in claim 24, wherein the base structure is located at one end of the center pipe structure.

29. An electronic percussion instrument stand as recited in claim 24, further comprising a holder for holding at least one electronic component, the holder coupled to both the first center pipe and the second center pipe.

30. An electronic percussion instrument stand as recited in claim 29, wherein the at least one electronic component includes a controller supported by the holder.

31. An electronic percussion instrument stand as recited in claim 24, wherein the base structure comprises a unitary body having a first and second receptacles for receiving the first and second center pipes.

32. The electronic percussion instrument stand as recited in claim 24, further comprising a connection member coupled to both the first pipe and the second pipe, the connection member being vertically spaced apart from the base structure, and wherein the at least one first joint is vertically located between the connection member and the base structure.

* * * * *